US005527031A

United States Patent [19]

Walsh et al.

[11] Patent Number: 5,527,031

[45] Date of Patent: Jun. 18, 1996

[54] MECHANISM FOR INSURING ALIGNMENT OF CURRENCY IN CURRENCY VALIDATORS

[75] Inventors: Michael Walsh, E. Patchoque; Miroslaw Blaszczec, Lindenhurst, both of N.Y.

[73] Assignee: Coin Bill Validator, Inc., Hauppauge, N.Y.

[21] Appl. No.: 260,062

[22] Filed: Jun. 15, 1994

[51] Int. Cl.[6] ..... B65H 7/02

[52] U.S. Cl. ..... 271/259; 271/261

[58] Field of Search ..... 271/261, 259, 271/258, 227, 258.01

[56] References Cited

U.S. PATENT DOCUMENTS

| | | | |
|---|---|---|---|
| 4,884,671 | 12/1989 | Gardellini | 194/207 |
| 5,259,490 | 11/1993 | Gardellini | 194/203 |
| 5,322,275 | 6/1994 | Gardellini et al. | 271/306 |

FOREIGN PATENT DOCUMENTS

| | | | |
|---|---|---|---|
| 61-235337 | 10/1986 | Japan | 271/261 |
| 63-225049 | 9/1988 | Japan | 271/261 |
| 2286543 | 11/1990 | Japan | 271/261 |

*Primary Examiner*—David H. Bollinger
*Attorney, Agent, or Firm*—Bauer & Schaffer

[57] ABSTRACT

A series of sensors are placed transversely to the line of movement of the bill so that the leading edge passes over the sensors substantially simultaneously. If the bill is misaligned and the sensors are blocked within a predetermined period, the bill will be rejected.

2 Claims, 2 Drawing Sheets

Fig. 1
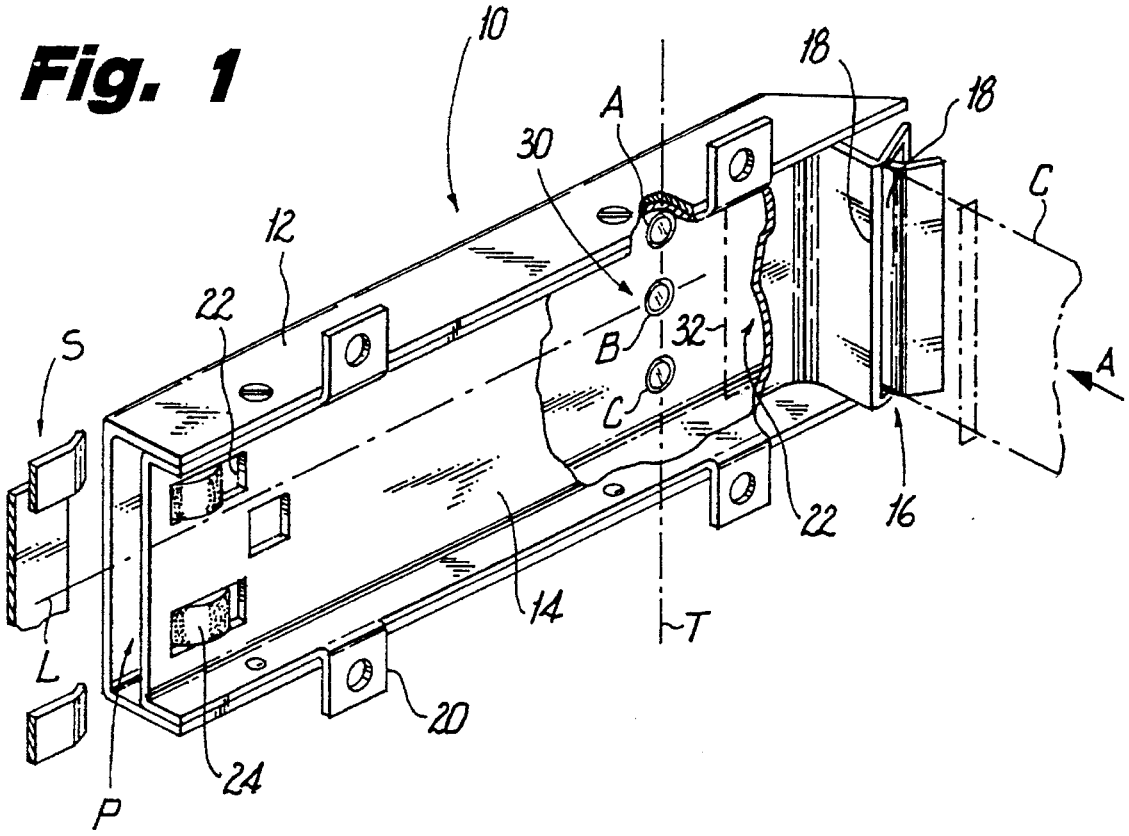
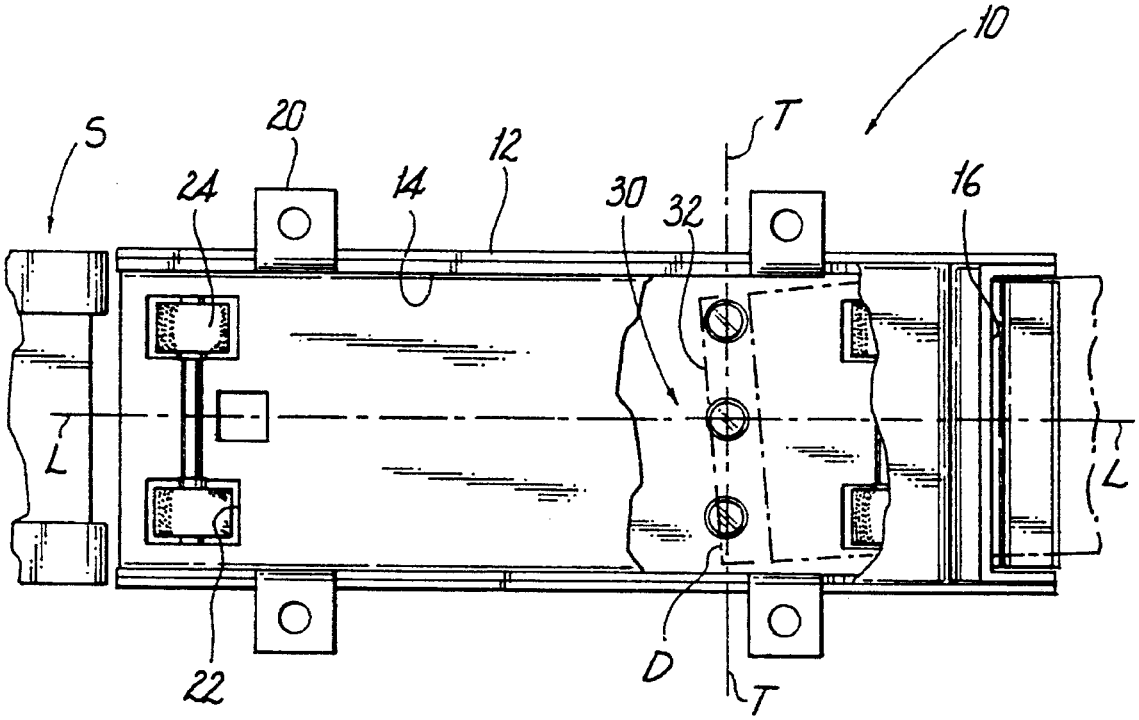
Fig. 2

MECHANISM FOR INSURING ALIGNMENT OF CURRENCY IN CURRENCY VALIDATORS

BACKGROUND OF INVENTION

The present invention relates to an improvement in the construction and operation of paper currency validators and, in particular, to mechanisms for insuring aligned passage of the bill through the validator.

Paper currency validators, sometimes commonly referred to as dollar bill changers, have come into wide use, for example, in retail establishments, airport terminals, train stations, libraries, and even casinos, where the acceptance of currency in exchange for goods and/or services is necessary and where professional change makers are unavailable.

Such machines, illustrated by the model IVO, manufactured by Coil Bill Validator, Inc. (CBV) of Deer Park, N.Y. are well known and commercially available. In these machines the currency is introduced along its lengthwise axis into a receiving slot and transferred through an elongated, narrow channel by a series of rollers and belts. During this travel, the currency is electronically sensed for its value as well as for its validity. If valid, it is passed on into a receiving stacker where it is stored to be later retrieved. If the currency is not valid it is returned and expelled through the inlet slot.

It is this introduction into a narrow slot and movement through a elongated narrow channel which gives rise to a problem which is both troublesome and costly. In the haste of making change and because of the lack of deftness and experience, a great number of users of the currency validators cause the bill to be introduced askew and not perfectly aligned. As a result, such bills tend to bind, crumple, and jam in the transfer channel during transfer by the belts and rollers. The user who is not aware of the problem tends to pull back the bill, causing it to rip, further aggravating the jam. A trained operator must then be called to unjam the machine and reset the mechanism. The result is loss of currency, downtime of the machine, and general annoyance.

It is, therefore, the object of the present invention to eliminate the foregoing problems.

It is a particular object of the present invention to recognize the introduction of a skewed bill and prevent it from causing the machine to jam.

It is a further object to provide a simple mechanism which may be inexpensively included in new machines or used in the retrofitting of machines already in the field.

These objects and advantages as well as others will be apparent from the following disclosure of the present invention.

SUMMARY OF THE INVENTION

According to the present invention, the elongated currency channel is provided with a plurality of sensors aligned in an axis perpendicular to the long axis of the channel. Each of the sensors independently sense the leading edge of the bill as it is inserted into the channel. The outputs of the sensors are arranged in combination with the circuit that powers motor driving the belts and rollers which propel or expel the bill further along the channel or out of the inlet. Thus, when the sensors substantially simultaneously sense the leading edge of the bill, the bill is determined to be entering the channel properly aligned along the axis of the channel. On the other hand, when less than all the sensors sense the leading edge within a given time period, the bill is deemed to be skewed and is then rejected.

For United States currency, it is preferred that only three sensors be aligned transversely to the length of the channel. For larger bills additional sensors may be used.

Preferably, the sensors may be photoelectric cells which simply sense light, the leading edge acting to sense light and, therefore, turn on or off. If desired, the sensor may be combined with others needs of the currency such as the validator sensors.

RELATED DISCLOSURE

The present currency validator employs certain details found in U.S. Pat. Nos. 4,884,671 and 5,259,490 issued to Ivo Gardellini, to which reference to such details and the disclosure of said patents are to be made as if more fully set forth herein.

The present invention is used also with the inventions disclosed in U.S. patent applications Ser. No. 08/260,120, entitled PAPER CURRENCY VALIDATOR (Attorney's Docket No. P-2824-6) and Ser. No. 08/260,061 entitled ELECTRICAL SWITCH CONNECTORS (Attorney's Docket No. P-2824-7), filed simultaneously herewith, by the same inventors. The disclosures of these applications are incorporated herein as if more fully set forth.

BRIEF DESCRIPTION OF THE DRAWINGS

In the drawings:

FIG. 1 is a perspective view of the inlet and transfer section of a currency validator;

FIG. 2 is a plan view of the inlet and transfer section shown in FIG. 1.

DESCRIPTION OF THE INVENTION

Figure 3:
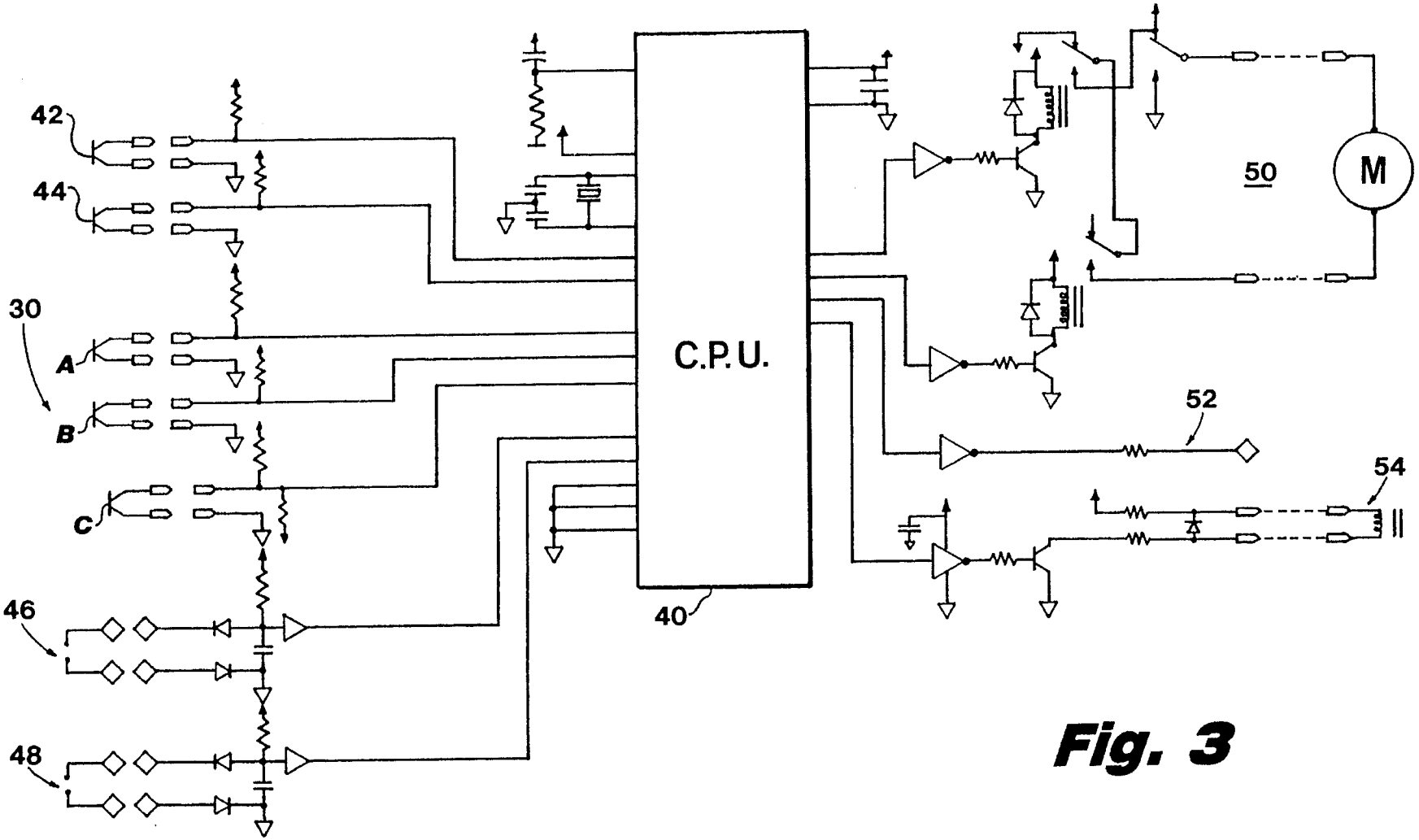
FIG. 3 is a circuit diagram for the mechanism shown in FIGS. 1 and 2.

As noted earlier, the present invention may be applied to newly built machines as well as retrofit onto machines already in use. Therefore, in the following description only that part of currency validators will be described and shown in the drawings as is necessary for an understanding of the present invention. However, reference is made to the aforementioned IVO model validator made by Coin Bill Validator, Inc. and to U.S. Pat. No. 4,884,671, issued Dec. 5, 1989, and U.S. patent applications, Ser. Nos. 07/771,188 and 07/771,189, both filed Oct. 4, 1991 (all in the name of Vedasto Gardellini). The foregoing patents and applications are incorporated herein as if more fully set forth.

As seen in FIG. 1, the inlet and transfer section, generally depicted by the numeral 10, comprises a base channel 12 and a cover channel 14 set within the base so as to provide a narrow but flat passageway P. Both the base channel 12 and the cover channel 14 are provided with shaped lips 18 through which the bill or currency C is inserted. The lips 18 may be curved so that the bill enters at an angle to the plane of the passageway P or in line with the passageway, as may be desired.

The inlet and transfer section 10 is mounted within a supporting housing (not shown), using the tabs 20. Also mounted in the housing to extend through suitable opening 22 in the channel members 12 and 14 are an arrangement of conveyor belts 24 and rollers which coact to grasp the bill or currency and move the bill forward through the passage, into a storage device S (partially shown) when the electronic sensors and testing mechanism determines the bill valid. The belts and rollers are motor driven, which motor is reversible so that on determination that the currency is invalid, or according to the present invention not presented correctly, it may be reversed and expelled from the machine.

As noted earlier, the object of this invention is to prevent jamming of the currency in the transfer passage as a result of misalignment of the currency as it is fed through the inlet. To this end, a number of discreet sensors 30 are set along an axis T transverse to the linear axis L of the passageway P. Each sensor is independent of the other and provides a separate output signal. The sensors may be photoelectric, tactile sensors such as microswitches and infrared sensors.

As the bill enters the passageway, a properly fed bill will have its leading edge 32 substantially transverse to the axis L and, therefore, parallel to the sensors 30. Thus, a properly fed will cross all of the sensors substantially simultaneously so as to trip each sensor at the same time. An improperly fed bill will trip the sensors 30 in a sequence which can be recognized by the not simultaneous tripping the sensors.

As seen in FIG. 3, the coin validator is provided with a control system comprising a CPU 40, to which various signals are received as for example those from sensors 42 and 44 sensing the introduction into the inlet 16 of a bill and its complete transfer to the storage device S; and trigger circuit 46 and 48 determining validity and value of the currency. The CPU 40 processes the incoming signals, providing an output to a control circuit 50 operating the motor M, which drive the conveyor system of belts and rollers to a display circuit 52 and to a storage operating circuit 54.

Combined with the otherwise conventional control system are the sensors 30 and the individual output from 30A, 30B, and 30C.

In simple manner the outputs of each of the sensors 30A, 30B, and 30C are sent to the CPU, which is programmed to interrupt operation of the motor M should the bill be faultily aligned as described above and to reverse the motor to expel the faulty bill. Preferably, the CPU is programmed so that a small lag time is provided after the tripping of the individual sensors 30A, 30B, and 30C so that a small degree of tolerance is provided before the motor is actually stopped and/or reversed. This will allow either the user and/or the machine itself to correct the alignment of the bill for transfer through the passageway. Such tolerance will obviate frequent stoppage of the machine and annoyance to the user.

It is preferred that the time lag be staged in strips D correlated to the stepping of the motor M to move the leading edge 32 of the bill, as for example a distance of 0.02315". Thus, the bill may be introduced at a slight angle to the transverse axis T, as seen in FIG. 2, and the sensors 30*a*, 30*b*, and 30*c* sequentially blocked by the leading edge. The CPU will be programmed so no matter which sensor 30*a*, 30*b*, or 30*c* is engaged first by the leading edge the sequence of motor steps will follow through the remaining sensors. In any event, all of the sensors must be blocked within a given time period or predetermined number of motor steps in order to define a properly aligned bill.

It will then be seen that the present invention provides a simple effective means for obtaining the objects and advantages earlier enumerated. An unexpected benefit is obtained from the present invention in that not only with misaligned currency be detected but also the mutilated bills which have faulty leading edges.

Various modifications and changes have been disclosed herein, and others will be apparent to those skilled in this art. Therefore, it is to be understood that the present disclosure is by way of illustrating and not limiting of the present invention.

What is claimed is:

1. In a currency validator having a channel passage into which said currency is inserted in predefined steps through said passage; means for indexing said currency in said predefined steps through said passage; a mechanism for sensing the alignment of the currency comprising a plurality of sensors aligned transversely to the axis of the passageway, said sensors individually and separately sensing the leading edge of the currency; and means for arresting the means for indexing said currency when the leading edge does not block all the sensors within a predetermined number of said predefined steps, and thereafter reversing the indexing means to repel the currency from the passage.

2. The mechanism according to claim 1, wherein said sensors are photoelectric cells.

* * * * *